United States Patent [19]

Pedersen

[11] 4,150,249

[45] Apr. 17, 1979

[54] FLAME RESISTANT CABLE STRUCTURE

[75] Inventor: Narve S. Pedersen, Drammen, Norway

[73] Assignee: A/S Norsk Kabelfabrik, Drammen, Norway

[21] Appl. No.: 863,725

[22] Filed: Dec. 23, 1977

[30] Foreign Application Priority Data

Jan. 12, 1977 [NO] Norway ..... 770097

[51] Int. Cl.[2] ..... H01B 9/02; H01B 11/06; H01B 7/02

[52] U.S. Cl. ..... 174/36; 174/103; 174/107; 174/115; 174/121 A

[58] Field of Search ..... 174/109, 107, 115, 103, 174/36, 121 A

[56] References Cited

U.S. PATENT DOCUMENTS

| | | | |
|---|---|---|---|
| 3,032,604 | 5/1962 | Timmons | 174/115 |
| 3,265,808 | 8/1966 | Binch | 174/107 |
| 3,489,844 | 1/1970 | Motley | 174/107 |
| 3,594,491 | 7/1971 | Ziedlhack | 174/115 |
| 3,772,455 | 11/1973 | Nicodemus | 174/121 A |
| 3,823,255 | 7/1974 | LaGase et al. | 174/121 A |
| 4,018,962 | 4/1977 | Pedlow | 174/121 A |
| 4,018,983 | 4/1977 | Pedlow | 174/121 A |
| 4,041,237 | 8/1977 | Stine et al. | 174/115 |

*Primary Examiner*—Laramie E. Askin
*Assistant Examiner*—E. F. Borchelt
*Attorney, Agent, or Firm*—Emrich, Root, O'Keeffe & Lee

[57] ABSTRACT

A cable structure for telecommunication or power supply applications, comprising one or more conductors, each of which is surrounded by a micatape embraced by an insulating layer of heat resistant rubber. The conductors are embraced by a thermoplastic elastomer on the outside of which there is placed a braided metal armour. The structure has an outer sheathing of chlorine sulphonated polyethylene or ethylene propylene rubber. Used as a three-conductor power cable the conductors are twisted together inside the layer of thermoplastic elastomer.

8 Claims, 11 Drawing Figures

FLAME RESISTANT CABLE STRUCTURE

BACKGROUND OF THE INVENTION

1. FIELD OF THE ART

The present invention relates to a flame resistent cable structure comprising one or more electrical conductors. The application of the cable structure according to the invention is both in the field of telecommunication and power supply.

2. DESCRIPTION OF PRIOR ART

The requirements which the electrical installation on oil drilling platforms and/or production platforms has to meet, is in many ways stricter than those of conventional installations on mainland sites. The reason therefor is that the conditions in connection with a possible fire on such platforms are substantially more hazardous than in connection with corresponding conditions on the mainland, and a perfect functioning of the current carrying cables upon the occurance of fire, is therefore of very great importance for a safe rescue of the crew on the platforms. If a fire should occur on a platform, many of the most important components onboard will presumably be connected through cables extending through the area or areas on fire. The fire resisting ability of such cables is therefore very important, that the cables can perform their functions as long as possible without the current supply, the control systems, the communication systems etc. breaking down and thereby paralysing the rescue work. Cables which are used for electrical installations on drilling platforms must therefore be designed while bearing in mind that besides from being resistant to flames and heat, they must not contribute to the spreading of the fire or develop noxious gases at extreme temperatures.

Besides, the cables must be designed with a view to achieving sturdy mechanical properties, so that even during ordinary working conditions on the platforms they remain operable throughout their predetermined lifetime.

SUMMARY OF THE INVENTION

In appreciation of the above, according to the present invention there is provided a flame resistant cable structure which besides from having a large resistance to being influenced by fire also have good mechanical properties, a fact which renders it well suited for installations on oil production platforms or similar offshore vessels.

The cable structure according to the present invention is characterized in that each conductor is surrounded by a micatape which is embraced by an insulating layer of heat resistant rubber, that the conductors and screens are embraced by a thermoplastic elastomer, that a braided metal armour is provided on the outside of the thermoplastic elastomer, and that the structure has an outer sheathing of chlorine sulphonated polyethylene.

Cables designed in accordance with the present invention meet the fire resistance conditions required by IEC, experiments having proved the cables to have fire resisting properties superior to those of previously known cables of similar type.

Compared with conventional cables the cable structure according to the invention exhibits undisturbed functional properties during and after a fire even during heavy vibration. Similarly the development of dense smoke, CO or HCL during fire is substantially reduced.

In the following the invention will be further described, reference being had to the drawings, which illustrates various embodiments of the flame resistant cable structure according to the invention.

DESCRIPTION OF THE PREFERRED EMBODIMENTS

Figure 1:
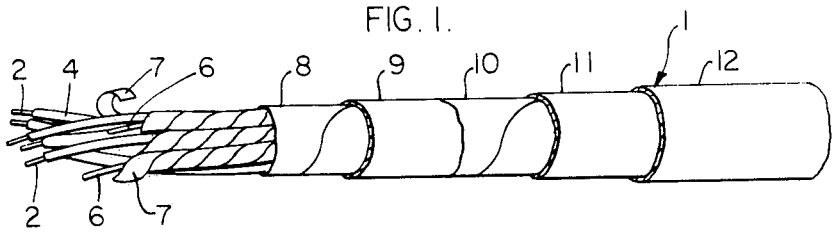
FIG. 1 is a perspective view of the end of a cable structure manufactured in accordance with the present invention with parts thereof cut away to show the components of the structure.
Figure 4:
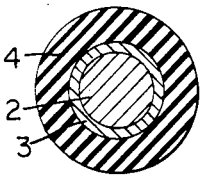
FIG. 4 is on a larger scale a cross section of a conductor having a two-layer insulation.
Figure 5:
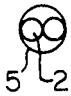
FIG. 5 is on a smaller scale a diagramatic cross section through a conductor pair surrounded by a plastic tape.
Figure 6:
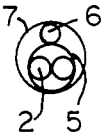
FIG. 6 is a diagramatic cross section through a conductor pair having their own earth conductor and screen.

The cable structure which is illustrated in FIG. 1 and which is generally designated by 1, comprises insulated single conductors 2, which are shown on a larger scale in FIG. 4. As seen from FIG. 4, the single conductors 2, which may be annealed copper, are surrounded by a micatape 3 and an insulating layer 4 of heat resistant rubber. The conductors may two by two be twisted together into pairs and kept separated from the other conductors by means of a plastic tape, as this is illustrated at 5 in FIGS. 5 and 6, and together with each of the wound conductor pairs an earth conductor 6 may be extended, as this is illustrated in FIGS. 1 and 6. This earth conductor may of course be omitted, as this is illustrated in FIG. 5. For reasons of survey the plastic tape 5 is omitted in FIG. 1.

Around each conductor pair and an earth conductor 6 there is wound an aluminum-plastic laminate 7 serving as an electric screen for the individual conductor pairs. Such a laminate is illustrated both in FIG. 1 and FIG. 6, and around these pairs of screened conductors there is wound a common polyester tape 8 (FIG. 1).

Outside the tape 8 there is deposited a layer 9 of thermoplastic elastomer which is filled with aluminum hydroxide, and on top of this layer there is wound an unbraided glass fibre mat 10 which together with the thermoplastic elastomer is embraced by a braided metal armour 11. The outer sheathing of the cable structure is designated by 12 and is manufactured from chlorine sulphonated polyethylene.

Experiments have shown that even if a cable designed as described above is subjected to fire, the electric properties will be maintained over very long periods of time even at very high temperatures. A cable of a type similar to that described above has been subjected to flame tests at temperatures of 650°, 800° and 1100° C. respectively. During the test the cable was placed under tension, and it came out that for all temperatures the lapse of time prior to the electrical breakdown of the cable was more than 30 minutes. Further, a cable as described above has been subjected to a flame test according to IEC 331, i.e. to 750° C. for a period of 3 hours. During the test the cable was under full operating tension. Neither during the flame test nor during the subesequent voltage test did any faults occur.

Vibration experiments have also been carried out for a flame tested cable of the above described type, cable samples subsequent to the flame test being placed in a vibration apparatus and for one hour subjected to vibration in the frequency range of 10–100 Hz, the cable sample concurrently being subjected to normal operating voltage. The test results indicated that no electric faults could be traced after the vibration test.

The cable sample was thereafter insulation tested, which indicated a dielectric strength of approx. 1–1.6 kV.

During the flame test it was observed that the cable sample was buring very steadily. No substantial degree of temperature rise in the interior of the cable was observed and neither did any swelling of the cable occur. This is due to the fact that the thermoplastic elastomer is filled with aluminum hydroxide which at approx. 150° C. evapourates $H_2O$ with subsequent cooling of the cable components located inside it.

During fire the thermoplastic material 9 and the layer of unbraided glass fibre 10 will form a pulverulent ash which insulates the electrical conductors against excess temperatures, said ash also affording an excellent support for the conductors. The pulverulent ash is in turn kept in position by the metal armour 11 located between the outer sheathing 12 and the thermoplastic elastomer 9 with the glass fibre mat 10. Besides, a comparatively low smoke developement was observed during the test.

From further observations made during the tests it has been ascertained that during the tests the combustion energy of the cables is approx. 10% below that of corresponding, known cables. The corrosion effect of the gases generated at moderate temperatures, i.e. at 150–200° C., is substantially lower in the cable according to the invention compared with known cables. Similarly the generation of CO of the new cable is substantially lower than that of known cables. This is also the case with the generation of HCL both at 280°, 650° and 1000° C.

Experiments have also shown that the development of dense smoke during fire is much lower in connection with the cable according to the present invention compared with conventional cable structures.

Besides, the cable structure according to the invention meets all the conditions required by IEC-standards inclusive IEC 331 (fire test for mineral insulated cables).

Preferably a synthetic rubber such as ethylene propylene rubber or silicone rubber is chosen as insulation for the individual conductors.

As mentioned the thermoplastic elastomer which serves as a filling sheathing and which may be an ethylene propylene elastomer, is filled with aluminum hydroxide for achieving the desired thermal properties. This composition is especially developed for the present cable and has an oxygen index larger than 35%. Besides from giving the cable a good mechanical strength, this filling sheathing shall also provide support for the individual conductors. During fire the filling sheathing acts as a cooling and heat insulating element for the screen laminate and the individual conductors. The ageing properties of the material are very good compared with e.g. the outer layer of chlorine sulphonated polyethylene.

In the cable according to the invention the mechanical protection is maintained by the metal armour 11 and the outer sheathing 12 of chlorine sulphonated polyethylene. The outer sheathing has an oxygen index higher than 35% and is the cable component generating HCl when the cable is subjected to flames and elevated temperatures. Chlorine sulphonated polyethylene has, however, good properties as to mechanical strength and resistance against oil. By replacing the outer sheathing 12 of chlorine sulphonated polyethylene with a sheathing of ethylene propylene rubber the generation of HCl during fire may be reduced.

In addition the cable according to the invention exhibits bending properties and strength properties which render it very well suited for installations in marine working environment.

Figure 2:
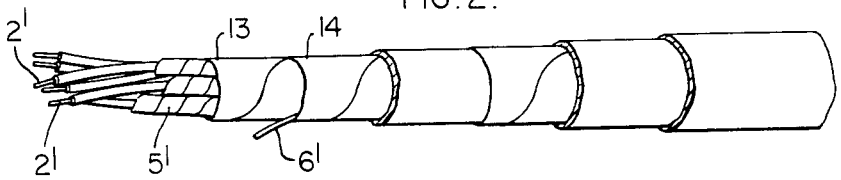
FIG. 2 is a perspective view similar to FIG. 1, of another embodiment of the cable structure according to the invention.

Another embodiment of the cable structure according to the invention is illustrated in FIG. 2. This differs from the structure according to FIG. 1 in that the individual conductors 2', which are kept together two by two by means of respective plastic tapes 5', have a common plastic tape 13 and a common screen 14 wound thereabout. A single common earth conductor 6' is provided between the plastic tape 13 and the screen 14. This embodiment is further illustrated in FIG. 9 and is to be regarded as a screened twisted structure.

Figure 3:
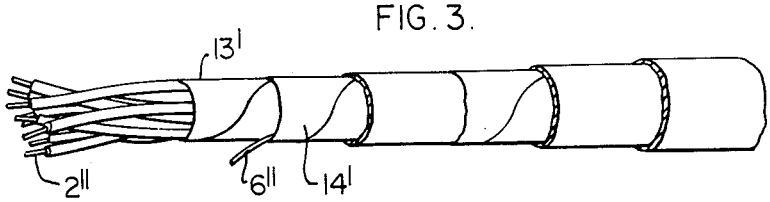
FIG. 3 is a view similar to FIGS. 1 and 2, and illustrates a further embodiment of the cable structure according to the invention.
Figure 9:
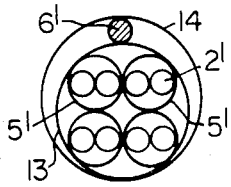
FIGS. 9 and 10 illustrate alternative embodiments of the conductor pairs.
Figure 10:
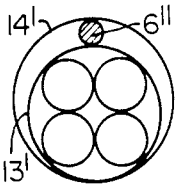

In FIG. 3 there is illustrated a third embodiment of the cable according to the invention and this differs from the embodiment of FIG. 2 only in a different arrangement of the individual conductors 2''. These are here arranged arbitrarily, but have wound thereabout a tape 13' of polyester and a screen 14'. Between the screen 14' and the tape 13' there is as before provided a common earth conductor 6''. The embodiment is further illustrated in FIG. 10. It is to be understood that the difference between the embodiments of FIGS. 9 and 10 is the use of plastic tape 5' in FIG. 9, whereas this is omitted in the embodiment of FIG. 10, the inner circles representing the circumference to be occupied by the twisted conductor pairs.

Figure 7:
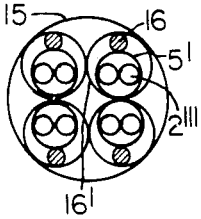
FIG. 7 is a diagramatic cross section which illustrates conductor pairs having individual earth conductors and common screen.
Figure 8:
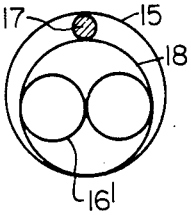
FIG. 8 is a diagramatic cross section illustrating two conductor pairs which besides from having their own earth conductor, also have a common earth conductor and a common screen.

In FIGS. 7 and 8 there are illustrated alternative embodiments as to how the cable pairs can be arranged in four or two pairs respectively, within a common screen 15. In FIG. 7 each pair of the individual conductors 2''' has its own earth conductor 16, whereas in the embodiment according to FIG. 8 a common earth conductor 17 is added. In FIGS. 7 and 8 16' designates a metal foil, and in FIG. 8 18 designates the circumference occupied in the cable by the individual pairs with earth conductor. If desired, 18 may designate a plastic tape.

Figure 11:
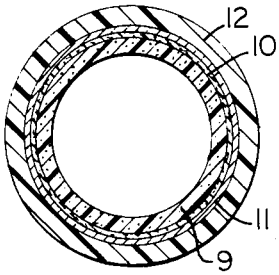
FIG. 11 is a cross section through an arbitrary embodiment of the cable according to the invention.

In FIG. 11, which illustrates a simplified cross section of an embodiment of a cable structure according to the invention, 12 designates as before the outer sheathing of either chlorine sulphonated polyethylene or ethylene propylene rubber which surrounds the braided armour 11. This in turn embraces the insulating layer 9 of thermoplastic elastomer. This layer fills the possible empty spaces which may exist between the conductor pairs, said layer forming a baking material for the non-braided glass mat 10.

If the cable is used as a three-conductor power cable, three conductors of the type illustrated in FIG. 4 and being surrounded by micatape embraced by the layer of heat resistant rubber insulation, are twisted together and surrounded by the thermoplastic elastomer 9, the non-braided glass mat 10, the braided armour 11 and the outer sheathing 12, as illustrated in FIG. 11. Any earth conductors and screens may then be deleted.

I claim:

1. A flame resistant cable structure having at least one conductor therein, including in combination, a micatape enclosing each of at least one conductor, an insulating layer comprised of heat resistant rubber surrounding said micatape, a thermoplastic elastomer layer filled with aluminum hydroxide surrounding said insulating layer, said micatape and said at least one conductor, a braided metal armour positioned about the thermoplastic elastomer, an unbraided glass fibre layer positioned between said thermoplastic elastomer layer and said braided metal armour to provide a seal between said elastomer layer and said metal armour, and an outer sheathing comprised of chlorine sulphonated polyethylene enclosing said braided metal armour.

2. The flame resistant cable structure in accordance with claim 1 and said cable structure includes a three-conductor power cable, each of said conductors is surrounded by said micatape embraced by said insulating layer of heat resistant rubber insulation and wherein each of said conductors are twisted together and surrounded by said thermoplastic elastomer layer filled with aluminum hydroxide.

3. The flame resistant cable structure in accordance with claim 1 further including at least two conductors each enclosed within said micatape and said insulating layer of heat resistant rubber and wherein said conductors are by pairs surrounded by a plastic tape and having an earth conductor member extending along each pair of conductors, with said conductor pairs and said earth conductor member being surrounded by a metal foil screen.

4. The flame resistant cable structure in accordance with claim 3 wherein bundles of screened conductor pairs are enclosed within a common metal foil.

5. The flame resistant cable structure in accordance with claim 1 further including at least two conductors each enclosed within said micatape and said insulating layer of heat resistant rubber and wherein said conductors are by pairs surrounded by a plastic tape to form a bundle, and wherein bundles of said conductor pairs having a common earth conductor extending along said bundles are surrounded by a common metal foil screen.

6. The flame resistant cable structure in accordance with claim 1 wherein said insulating layer is comprised of ethylene propylene rubber.

7. The flame resistant cable structure in accordance with claim 1 wherein said insulating layer is comprised of silicone rubber.

8. A flame resistant cable structure having at least one conductor therein, including in combination, a micatape enclosing each of at least one conductor, an insulating layer comprised of heat resistant rubber surrounding said micatape, a thermoplastic elastomer layer filled with aluminum hydroxide surrounding said insulating layer, said micatape and said at least one conductor, a braided metal armour positioned about the thermoplastic elastomer, an unbraided glass fibre layer positioned between said thermoplastic elastomer layer and said braided metal armour to provide a seal between said elastomer layer and said metal armour, and an outer sheathing comprised of ethylene propylene rubber enclosing said braided metal armour.

* * * * *